US006427484B1

(12) United States Patent
Choi et al.

(10) Patent No.: US 6,427,484 B1
(45) Date of Patent: Aug. 6, 2002

(54) AIR CONDITIONER HAVING OXYGEN ENRICHING DEVICE

(75) Inventors: Young Hoon Choi; Kwan Choull Park; Sang Min Kim, all of Seoul (KR)

(73) Assignee: Daewoo Electronics Co., Ltd. (KR)

( * ) Notice: Subject to any disclaimer, the term of this patent is extended or adjusted under 35 U.S.C. 154(b) by 0 days.

(21) Appl. No.: 09/972,808

(22) Filed: Oct. 4, 2001

(30) Foreign Application Priority Data

Feb. 28, 2001 (KR) ..... 01-10268
Feb. 28, 2001 (KR) ..... 01-10270
Feb. 28, 2001 (KR) ..... 01-10271

(51) Int. Cl.[7] ..... F25J 1/50; F24F 3/16
(52) U.S. Cl. ..... 62/640; 62/78; 62/498
(58) Field of Search ..... 62/78, 498, 640

(56) References Cited

U.S. PATENT DOCUMENTS 4,896,514 A * 1/1990 Sugiyama et al. ..... 62/78
4,976,109 A * 12/1990 Garrett ..... 62/78
5,120,329 A * 6/1992 Sauer et al. ..... 62/78
5,170,637 A * 12/1992 Shyu ..... 62/176.1
5,332,547 A * 7/1994 Olson et al. ..... 62/78
5,890,366 A * 4/1999 Yang ..... 62/908

FOREIGN PATENT DOCUMENTS

GB 2122103 1/1984
JP 3217732 9/1991

* cited by examiner

*Primary Examiner*—Ronald Capossela
(74) *Attorney, Agent, or Firm*—Anderson Kill & Olick, PC

(57) ABSTRACT

An air conditioner includes an oxygen-enriched air separator for separating exterior air into oxygen-enriched air and nitrogen-enriched air and an oxygen-enriched air supplier for supplying the separated oxygen-enriched air to an indoor unit. The oxygen-enriched air separator has a main body, an oxygen-enriched air outlet port connected to the indoor unit through a supply tube, a nitrogen-enriched air outlet port for exhausting the nitrogen enriched air and a pressure maintenance unit for maintaining a pressure difference between a first space communicated with the nitrogen-enriched air outlet port and a second space communicated with the oxygen-enriched air outlet port over a predetermined level.

12 Claims, 6 Drawing Sheets

AIR CONDITIONER HAVING OXYGEN ENRICHING DEVICE

FIELD OF THE INVENTION

The present invention relates to an air conditioner; and, more particularly, to an air conditioner having an oxygen-enriching device capable of providing oxygen-enriched air to the room.

BACKGROUND OF THE INVENTION

As air conditioners are widely used, many activities are performed in a closed room. However, when the room is maintained in a closed state for a long time, a variety of side effects, e.g., breathing difficulty, headache, weakening of memory, etc., may be caused.

As an effort to resolve these problems, oxygen enriched air separation systems capable of supplying oxygen to room have been developed. In general, the oxygen enriched air separation systems employ separation membranes having selective permeability to oxygen. FIG. 1 shows a conventional oxygen enriched air separator.

As shown in FIG. 1, the oxygen enriched air separator includes a hollow main body 10 and a plurality of cylindrical separation membranes 20 installed within the main body 10. The inside of the main body 10 is divided into two spaces 11*a* and 11*b* by the separation membranes 20. The air introduced to the first space 11*a* permeates the separation membranes 20 and is transferred to the second space 11*b* due to the pressure difference between the first and the second space 11*a* and 11*b*. The air transferred to the second space 11*b* becomes to have a high oxygen concentration ranging from about 30% to 45% (referred to as oxygen enriched air hereinafter) since the separation membranes have high selective permeability for oxygen. Meanwhile, the air left in the first space 11*a* (referred to as nitrogen enriched air since the nitrogen concentration of this air is comparatively high) is exhausted through a nitrogen enriched air outlet port 17 prepared at one side of the main body 10.

However, this conventional oxygen enriched air separator has a drawback in that a great deal of noises are generated when the nitrogen enriched air, i.e., the air left after the oxygen is separated, is exhausted. It seems to be because the nitrogen enriched air outlet port is just an open end.

Further, since the oxygen selective permeability of the separation membranes is sensitive to temperature variations and readily deteriorated during wintertime when temperature is low, the efficiency of the oxygen enriched air separator is greatly decreased during winter.

SUMMARY OF THE INVENTION

It is, therefore, an object of the present invention to provide an oxygen-enriched air separator capable of maintaining a large pressure difference -between a first and a second space.

It is another object of the present invention to provide an oxygen-enriched air separator having separation membranes capable of exhibiting excellent oxygen selective permeability regardless of an exterior temperature.

In accordance with one aspect of the present invention, there is provided an air conditioner comprising an outdoor unit having an outdoor heat exchanger for performing heat exchange between a heat-exchanging medium and exterior air; an indoor unit having an indoor heat exchanger for performing heat exchange between room air and the heat-exchanging medium; and an oxygen-enriched air supplying device including an air compressor for providing a compressed air, an oxygen-enriched air separator for separating the compressed air into oxygen-enriched air and nitrogen-enriched air; and a supply tube for supplying the oxygen-enriched air provided from the oxygen-enriched air separator to the indoor unit, wherein the oxygen enriched air separator includes a main body; an oxygen-enriched air outlet port exhausting the oxygen-enriched air through the supply tube; a nitrogen-enriched air outlet port for exhausting the nitrogen-enriched air to the atmosphere; separation membranes for separating the compressed air into an oxygen enriched air and a nitrogen enriched air, wherein an inside of the main body is divided into a first space communicated with the nitrogen-enriched air outlet port and a second space communicated with the oxygen-enriched air outlet port; and a pressure maintenance unit for maintaining a pressure difference between the first and the second space greater than a predetermined level.

In accordance with another aspect of the present invention, there is provided an air conditioner comprising an outdoor unit having an outdoor heat exchanger for performing heat exchange between a heat-exchanging medium and exterior air; an indoor unit having an indoor heat exchanger for performing heat exchange between room air and the heat-exchanging medium; and an oxygen-enriched air supplying device including an air compressor for providing a compressed air; an oxygen-enriched air separator for separating the compressed air into oxygen-enriched air and nitrogen-enriched air; and a supply tube for supplying the oxygen-enriched air provided from the oxygen-enriched air separator to the indoor unit, wherein the oxygen enriched air separator includes a main body; an oxygen-enriched air outlet port connected to the indoor unit through the supply tube; a nitrogen-enriched air outlet port for exhausting the nitrogen-enriched air to the outside; and separation membranes for separating the compressed air into an oxygen enriched air and a nitrogen enriched air, wherein an inside of the main body is divided into a first space communicated with the nitrogen-enriched air outlet port and a second space communicated with the oxygen-enriched air outlet port; and a heating means for heating the separation membranes up to a predetermined temperature so as to improve the oxygen selective permeability of the separation membranes.

DESCRIPTION OF THE DRAWINGS

The above and other objects and features of the present invention will become apparent from the following description of preferred embodiments given in conjunction with the accompanying drawings, in which.

DESCRIPTION OF THE INVENTION

Figure 1:
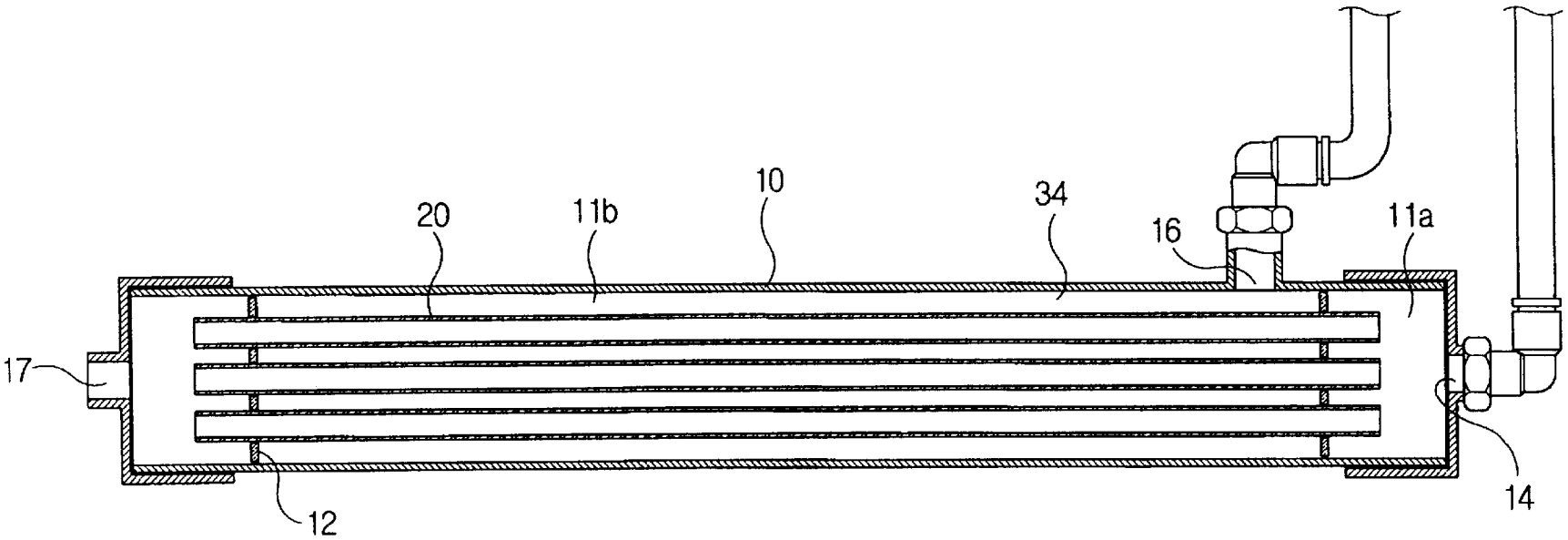
FIG. 1 sets forth a cross-sectional view of a conventional air conditioner.
Figure 2:
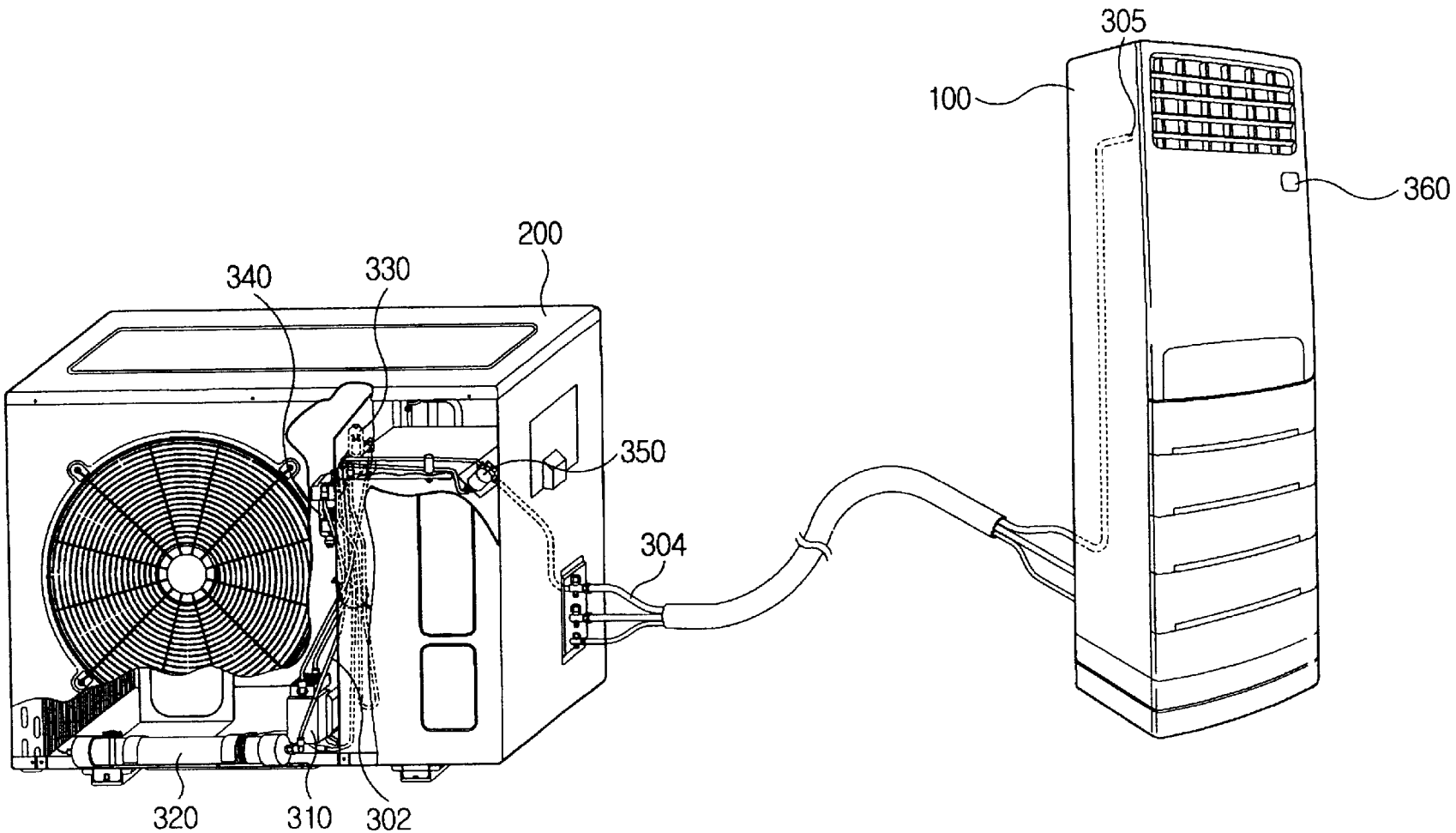
FIG. 2 provides a perspective view of an air conditioner in accordance with the present invention.

Referring to FIG. 2, there is provided an air conditioner in accordance with the present invention. The air conditioner includes an indoor unit 100, an outdoor unit 200 and an oxygen-enriched air supplier.

Figure 3:
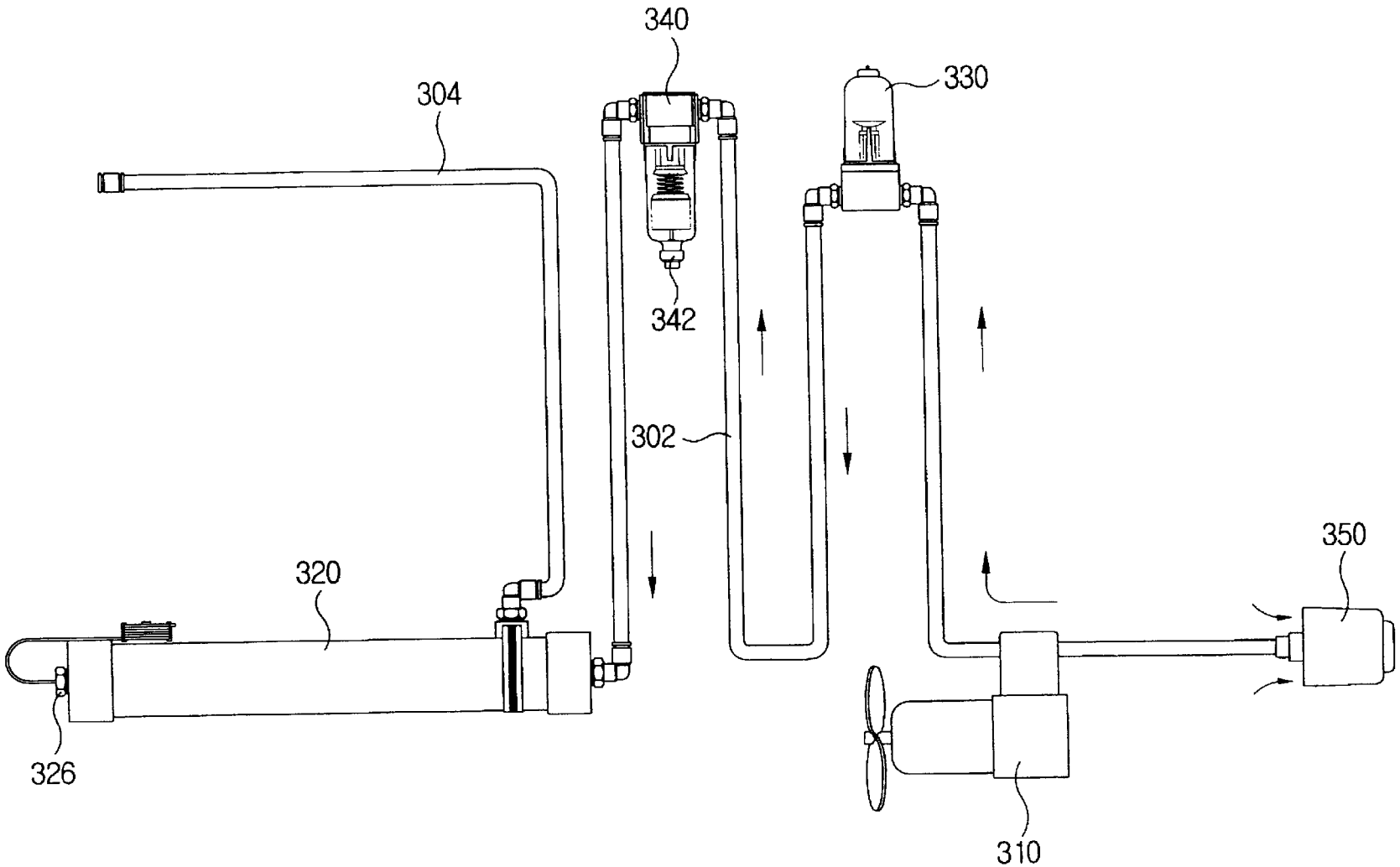
FIG. 3 is a schematic view of an oxygen-enriched air supplier in accordance with a first embodiment of the present invention.

FIG. 3 provides a schematic drawing of the oxygen-enriched air supplier shown in FIG. 2.

Referring to FIGS. 2 and 3, the oxygen-enriched air supplier includes an air compressor 310, an oxygen-enriched air separator 320, a first and a second filter assembly 330 and 340, a muffler 350, an oxygen sensor 360 and a control unit (not shown).

The air compressor 310 is installed at one side of the outdoor unit 200 to compress the air introduced from the outside.

The oxygen-enriched air separator 320 has one inlet port, two outlet ports and separation membranes installed therein. The inlet port of the oxygen-enriched air separator 320 is communicated with the air compressor 310. One of the two outlet ports of the oxygen-enriched air separator 320 is a nitrogen-enriched air outlet port 326 and the other is an oxygen-enriched air outlet port, wherein the nitrogen-enriched air outlet port is communicated with the outside of the room while the oxygen-enriched air outlet port is communicated with the room through an oxygen-enriched air introducing pipe 304. Further, the separation membranes have high oxygen selective permeability and are preferably made of, e.g., polyimide. However, it should be noted that the material of the separation membrane members is not limited to polyimide but can be any material having oxygen selective permeability, e.g., triacetate, polyculfone, polyolefine, and the like.

The first and the second filter assembly 330 and 340 are installed at a connection pipe 302 between the air compressor 310 and the oxygen-enriched air separator 320 to remove impurities contained in the air compressed by the air compressor 310. Further, the first filter assembly 330 removes a pulsating pressure of the compressed air generated from the air compressor 310 and the second filter assembly 340 eliminates condensed water from the compressed air and discharges the condensed water through an exhaust valve 342 installed therein.

The muffler 350 has a plurality of noise reduction materials stacked therein and is installed near a suction unit of the air compressor 320 to reduce noises generated when exterior air is introduced into the air compressor 320. Preferably, the muffler 350 also operates to remove impurities contained in the air.

The oxygen sensor 360 installed at one side of the indoor unit detects an oxygen concentration in room air and inputs the estimated oxygen concentration to the control part.

The control part controls operations of the oxygen enriched air supplier by on/off operating the air compressor 310 depending on the oxygen concentration inputted from the oxygen sensor 360 to thereby allow the environment of the room to be maintained in an optimum condition. Concurrently, the control part also controls overall operations of the indoor unit and the outdoor unit of the air conditioner.

Meanwhile, a carbon dioxide sensor can be used in lieu of or along with the oxygen sensor 360. Further, a CO sensor, $NO_x$ sensor or $SO_x$ sensor can be used independently of the oxygen sensor depending on the room environment. Still further, a timer can be utilized in addition to these sensors, wherein the control part controls the air compressor to operate during a time period set by a user.

The operation of the oxygen-enriched air supplier is initiated when an oxygen-enriched air supplying function is chosen in a manual operation mode. On the other hand, in an automatic operation mode, the control part initiates the operation of the oxygen-enriched air supplier when the oxygen concentration in the room air is detected by the oxygen sensor 360 to be under a predetermined level.

Supply of the oxygen-enriched air is triggered by an operation of the air compressor 310. The air from the outside of the room is introduced into and compressed by the air compressor 310 after passing through the muffler 350. Noises generated when the air is introduced into the air compressor 310 is greatly reduced while the introduced air passes through the noise reduction materials prepared in the muffler 350. Further, impurities contained in the introduced air are also removed while the air passes through muffler 350. The impurity-removed air is compressed by the air compressor 310 at a high temperature with a high pressure. Then the compressed air is introduced through the connection pipe 302 to the oxygen-enriched air separator 320. While the compressed air travels through the connection pipe 302, the first and the second filter assembly 330 and 340 installed between the air compressor 310 and the oxygen-enriched air separator 320, respectively, remove impurities and condensed water from the compressed air.

The oxygen-enriched air separator 320 separates the introduced air into an oxygen-enriched air having a higher oxygen concentration than ordinary air and a nitrogen-enriched air comparatively having a smaller oxygen concentration than the ordinary air by using the selectively oxygen permeable separation membranes installed therein. The oxygen concentration: of the oxygen-enriched air approximately ranges from about 30% to 45%. However, the oxygen concentration of the oxygen-enriched air can be further increased up to 50% by changing a pressure or a flow rate of the compressed air being introduced into the oxygen-enriched air separator 320 or by installing two or more oxygen-enriched air separators in series.

The separated oxygen-enriched air is introduced into the indoor unit 100 of the air conditioner through the oxygen-enriched air introducing pipe 304 connected to the oxygen-enriched air outlet port and discharged to the room through an oxygen-enriched air discharge port 305 prepared at the end of the oxygen-enriched air introducing tube 304. On the other hand, the separated nitrogen-enriched air is exhausted to the outside of the room through the nitrogen-enriched air outlet port 326.

If the oxygen-enriched air is continuously supplied to the room to such an extent that the oxygen concentration in the room is detected by the sensor 360 to reach or exceeds a predetermined level, e.g., about 22% to 23%, (or when the $CO_2$ concentration in the air is detected to be, e.g., 18% or less by the $CO_2$ sensor), or if an operation stop signal is inputted in the manual operation mode, the control part cuts the supply of the oxygen-enriched air by stopping the operation of the air compressor 310.

Figure 4:
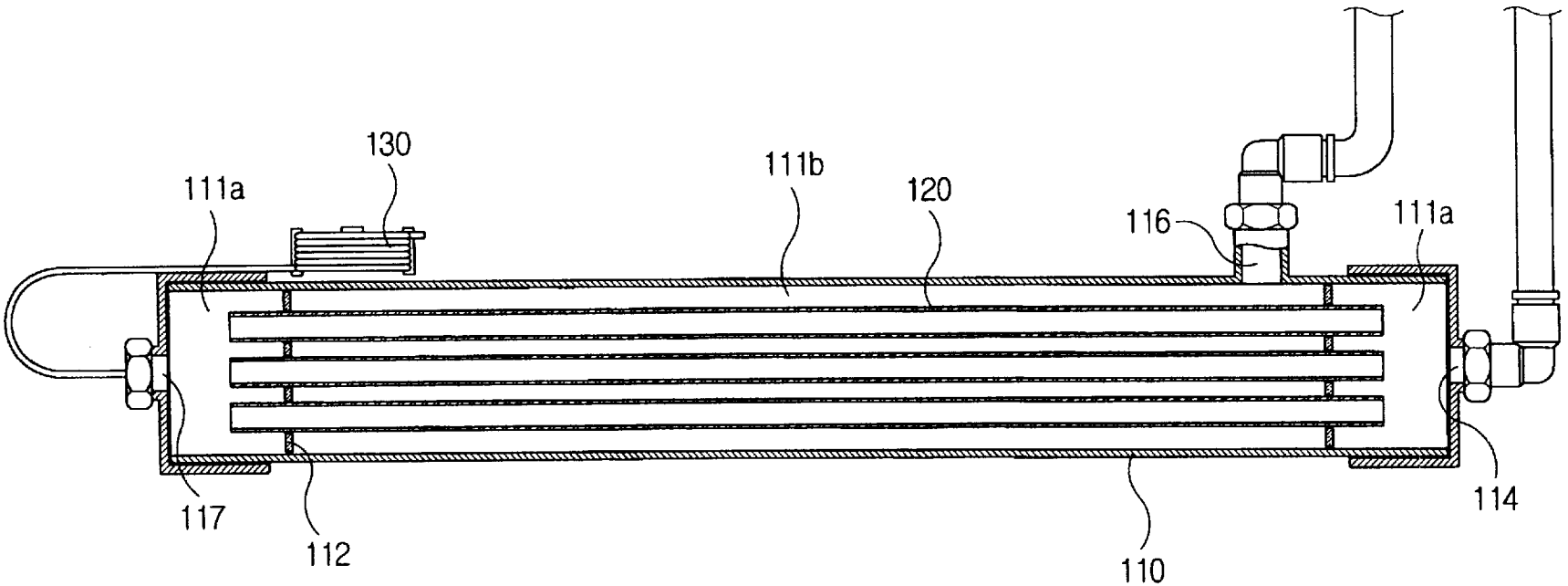
FIG. 4 is a lateral cross-sectional view of an oxygen-enriched air supplier in accordance with the first embodiment of the present invention.

Referring to FIG. 4, there is illustrated an oxygen-enriched air separator in accordance with the first embodiment of the present invention.

The oxygen enriched air separator includes a main body 110, separation membranes 120 and a pressure maintenance unit. The main body 110 is a hollow cylinder-shaped member and a plurality of separation membranes 120 are accommodated within the main body 110 by a pair of bulk heads 112, wherein the separation membranes are cylindrical tubes with two end portions thereof open. The separation membranes 120 are made of materials with high selective permeability of oxygen over any other elements in the air, e.g., polyimid. The inside of the main body 110 is divided by the bulk heads 112 and the separation membranes 120 into a first space 111*a* communicated with the inside of the separation membranes 120 and a second space 111*b* communicated with the outside of the separation membranes 120.

An inlet port 114 of the main body 110 and a nitrogen-enriched air outlet port 117 are communicated with the first space 111*a,* whereas an oxygen-enriched air outlet port 116 is communicated with the second space 111*b.* The pressure maintenance unit herein used is a narrow tube 130 installed at the nitrogen-enriched air outlet port 117 and is preferably installed spirally wound.

After being introduced into the oxygen enriched air separator through the inlet port 114, some of the compressed air permeates the separation membranes 120 and moves from the first space 111*a* to the second space 111*b* while the rest of the air is exhausted through the narrow tube 130 prepared at the nitrogen-enriched air outlet port 117. A discharge rate and a discharge pressure of the nitrogen-enriched air can always be maintained at a predetermined level since the narrow tube 130 through which the nitrogen-enriched air is exhausted has a high flow resistance.

Accordingly, the air introduced into the first space 111*a* may not by exhausted to the outside through the nitrogen-enriched air outlet port 117 with as high a speed as conventional cases, so that the pressure difference between the first and the second space 111*a* and 111*b* can be maintained over a predetermined level and the efficiency of oxygen-enriched air separating process can be greatly improved. Further, the pressure difference between the nitrogen-enriched air exhausted to the outside through the narrow tube 130 and the atmosphere outside of the room can be minimized by adjusting the length of the narrow tube 13. As a result, noises generated when the nitrogen-enriched air is exhausted can also be minimized.

Figure 5:
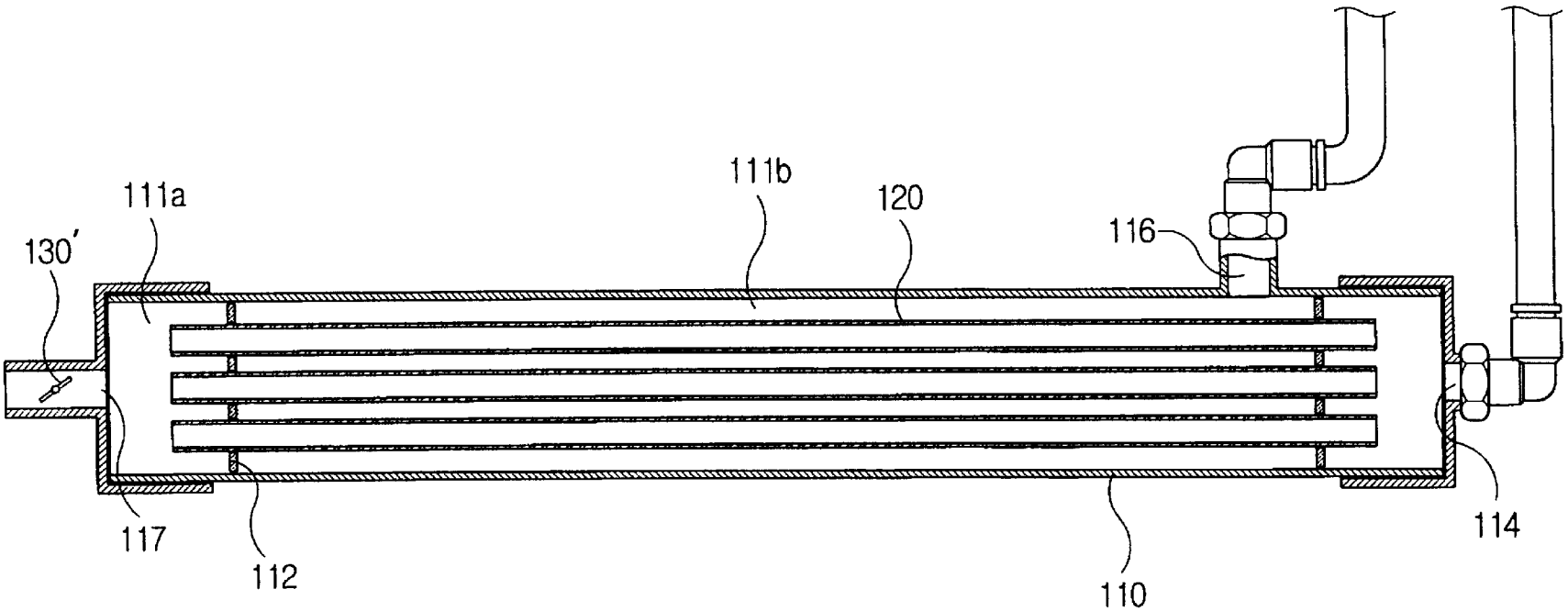
FIG. 5 offers a side cross-sectional view of an oxygen-enriched air supplier in accordance with a second embodiment of the present invention.

Referring to FIG. 5, there is shown an oxygen-enriched air separator in accordance with a second embodiment of the present invention.

The oxygen-enriched air separator in accordance with the second embodiment has the same constitutions as that of the first embodiment as shown in FIG. 2 excepting that the pressure maintenance device of the oxygen enriched air separator in the second embodiment is a valve 130' in lieu of the narrow tube 130 as in the first embodiment.

The valve 130' controls the discharge rate of the air exhausted through the nitrogen-enriched air outlet port 117 to be small by regularly maintaining a cross sectional area of the air flow passage in the nitrogen-enriched air outlet 117. Accordingly, the same effects as in the first embodiment can be obtained. Further, the discharge rate and the discharge pressure of the nitrogen-enriched air can also be adjusted by controlling the opening of the valve 130'.

Figure 6:
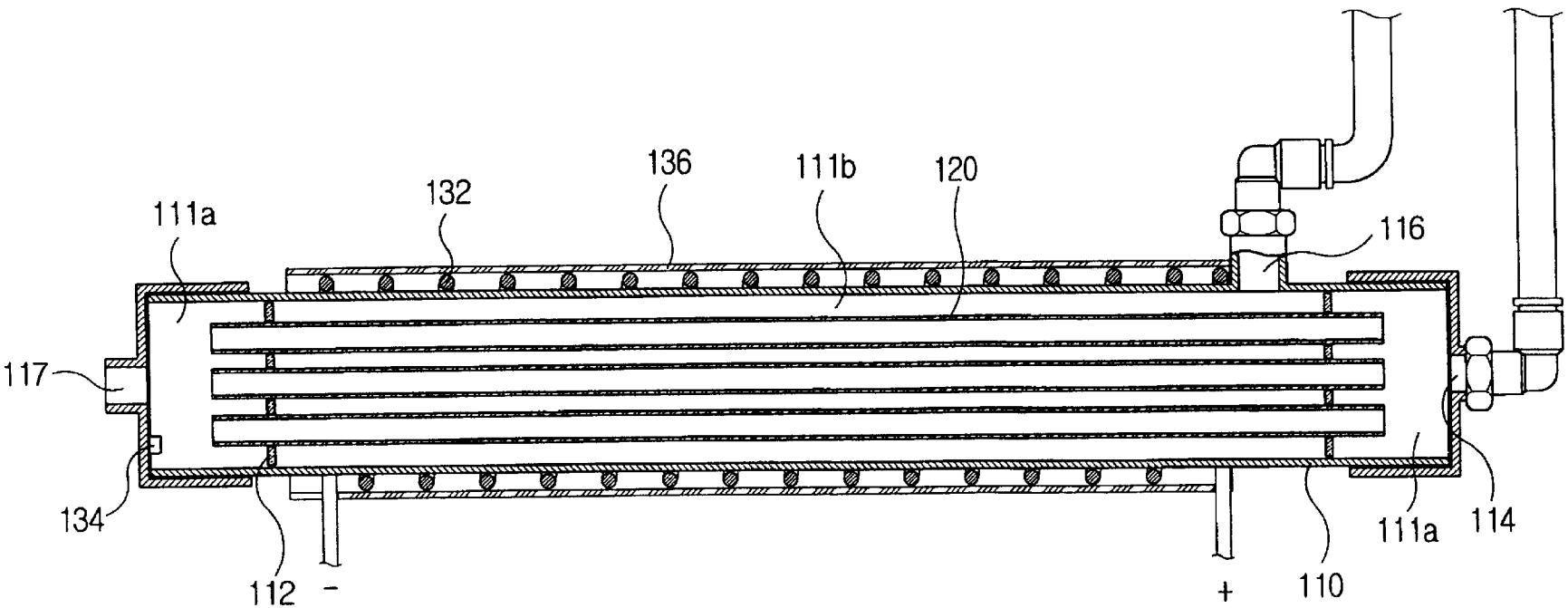
FIG. 6 illustrates an oxygen-enriched air separator in accordance with a third embodiment of the present invention.

Referring to FIG. 6, there is presented an oxygen-enriched air separator in accordance with a third embodiment of the present invention.

The oxygen enriched air separator includes a main body 110, separation membranes 120 and a heating unit 130 having a heating wire 132, a power switch (not shown), a temperature sensor 134 and a case 136. The heating unit 130 is installed at the exterior of the main body 110 in such a manner as to surround the main body 110. The heating wire 132 is disposed around the main body 110 and is connected to a power source through the power switch. Preferably, the heating wire 132 is spirally wound around the outer surface of the main body 110. The temperature sensor 134 is installed in either the first space 111*a* or the second space 111*b* of the main body 110. The power switch applies or cuts power to the heating wire 134 depending on a temperature detected by the temperature sensor 134. The case 136 accommodates both the main body 110 and the heating wire 132 disposed around the main body 110 to prevent the heating wires 132 from being exposed to the outside.

If the temperature within the main body 110 is detected by the temperature sensor 134 to exceed a reference value, e.g., 10° C., the power switch is maintained in an off state. However, if the temperature of the main body is detected to be under the reference value, the power switch is turned on and allows the power to be applied to the heating wire 132. Then, the heating wire 132 heats the main body 110 and the separation membranes 120 installed inside of the main body 110. If the separation membranes 120 are fully heated enough to exhibit the oxygen selective permeability, i.e., if the temperature of the main body reaches, e.g., about 60° C., the power switch becomes turned off again. Accordingly, the oxygen-enriched air separator in accordance with the present invention can effectively supply oxygen to the room regardless of the outside temperature.

While the present invention has been described with respect to the preferred embodiments, it will be understood by those skilled in the art that various changes and modifications may be made without departing from the spirit and scope of the invention as defined in the following claims.

What is claimed is:

1. An air conditioner comprising:

an outdoor unit having an outdoor heat exchanger for performing heat exchange between a heat-exchanging medium and exterior air;

an indoor unit having an indoor heat exchanger for performing heat exchange between room air and the heat-exchanging medium; and an oxygen-enriched air supplying device including an air compressor for providing a compressed air, an oxygen-enriched air separator for separating the compressed air into oxygen-enriched air and nitrogen-enriched air; and a supply tube for supplying the oxygen-enriched air provided from the oxygen-enriched air separator to the indoor unit, wherein the oxygen enriched air separator includes:

a main body;

an oxygen-enriched air outlet port exhausting the oxygen-enriched air through the supply tube;

a nitrogen-enriched air outlet port for exhausting the nitrogen-enriched air to the atmosphere;

separation membranes for separating the compressed air into an oxygen enriched air and a nitrogen-enriched air, wherein an inside of the main body is divided into a first space communicated with the nitrogen-enriched air outlet port and a second space communicated with the oxygen-enriched air outlet port; and a pressure maintenance unit for maintaining a pressure difference between the first and the second space greater than a predetermined level.

2. The air conditioner of claim 1, wherein the pressure maintenance unit is an open-ended narrow tube extended from the nitrogen-enriched air outlet port.

3. The air conditioner of claim 2, wherein the narrow tube is spirally wound.

4. The air conditioner of claim 1, wherein the pressure maintenance unit is a valve installed at the nitrogen-enriched air outlet port.

5. The air conditioner of claim 1, wherein the oxygen-enriched air supplier further-including:

a first filter assembly installed at a connection pipe between the air compressor and the oxygen-enriched air separator so as to remove impurities in the compressed air and reduce a pulsating pressure of the compressed air;

a second filter assembly installed at the connection pipe between the air compressor and the oxygen-enriched air separator so as to remove impurities and condensed water from the compressed air.

6. The air conditioner of claim 5 wherein the second filter assembly has an exhaust valve for discharging the separated condensed water.

7. The air conditioner of claim 1, wherein the oxygen enriched air supplier further including:

a sensor for detecting a room environment; and a control part for controlling operations of the indoor unit, the outdoor unit and the air compressor depending on the detected room environment.

8. The air conditioner of claim 7, wherein the sensor is an oxygen sensor for detecting an oxygen concentration in the room air.

9. The air conditioner of claim 7, wherein the sensor is a carbon dioxide sensor for detecting a carbon dioxide concentration in the room air.

10. The air conditioner of claim 1, wherein the oxygen-enriched air supplier further includes a muffler installed near a suction unit of the air compressor.

11. An air conditioner comprising:

an outdoor unit having an outdoor heat exchanger for performing heat exchange between a heat-exchanging medium and exterior air;

an indoor unit having an indoor heat exchanger for performing heat exchange between room air and the heat-exchanging medium; and an oxygen-enriched air supplying device including an air compressor for providing a compressed air; an oxygen-enriched air separator for separating the compressed air into oxygen-enriched air and nitrogen-enriched air; and a supply tube for supplying the oxygen-enriched air provided from the oxygen-enriched air separator to the indoor unit, wherein the oxygen enriched air separator includes:

a main body;

an oxygen-enriched air outlet port connected to the indoor unit through the supply tube;

a nitrogen-enriched air outlet port for exhausting the nitrogen-enriched air to the outside; and separation membranes for separating the compressed air into an oxygen enriched air and a nitrogen enriched air, wherein an inside of the main body is divided into a first space communicated with the nitrogen-enriched air outlet port and a second space communicated with the oxygen-enriched air outlet port; and a heating means for heating the separation membranes up to a predetermined temperature so as to improve the oxygen selective permeability of the separation membranes.

12. The air conditioner of claim 11, wherein the heating means includes:

a heating wire disposed around the main body;

a temperature sensor for detecting a temperature of the inside of the main body or an outside of the main body;

a switch for controlling power applied to the heating wire, wherein the switch is turned on when the temperature detected by the temperature sensor is below a first reference value and turned off when the temperature detected by the temperature sensor exceeds a second reference value higher than the first reference value.

* * * * *